US007760170B2

(12) United States Patent
Bae et al.

(10) Patent No.: US 7,760,170 B2
(45) Date of Patent: Jul. 20, 2010

(54) LIGHT EMITTING DEVICE WITH AT LEAST ONE SCAN LINE CONNECTING TWO SCAN DRIVERS

(75) Inventors: Hyo Dae Bae, Daegu (KR); Hak Su Kim, Seoul (KR); Do Wan Kim, Ulsan (KR)

(73) Assignee: LG Electronics Inc., Seoul (KR)

( * ) Notice: Subject to any disclaimer, the term of this patent is extended or adjusted under 35 U.S.C. 154(b) by 984 days.

(21) Appl. No.: 11/373,313

(22) Filed: Mar. 13, 2006

(65) Prior Publication Data

US 2007/0109233 A1 May 17, 2007

(30) Foreign Application Priority Data

Nov. 16, 2005 (KR) ..... 10-2005-0109664
Nov. 17, 2005 (KR) ..... 10-2005-0110402

(51) Int. Cl.
*G09G 3/32* (2006.01)

(52) U.S. Cl. ..... 345/82; 345/204

(58) Field of Classification Search ..... 345/82
See application file for complete search history.

(56) References Cited

U.S. PATENT DOCUMENTS 5,006,838 A 4/1991 Fujioka et al.
5,973,456 A 10/1999 Osada et al. ..... 315/169.1
6,091,392 A * 7/2000 Imamura ..... 345/100
6,246,385 B1 * 6/2001 Kinoshita et al. ..... 345/87
6,504,520 B1 1/2003 Osada et al. ..... 345/76
6,894,667 B1 * 5/2005 Lin ..... 345/87
2001/0020995 A1 * 9/2001 Kim ..... 349/149
2004/0135956 A1 * 7/2004 Kim et al. ..... 349/148
2004/0207315 A1 * 10/2004 Robbie et al. ..... 313/504
2007/0085779 A1 * 4/2007 Smith et al. ..... 345/76

FOREIGN PATENT DOCUMENTS

EP 0 875 879 A1 11/1998
JP 07-325554 12/1995
JP 09-281928 10/1997
KR 1020030024992 3/2003

OTHER PUBLICATIONS

Chinese Office Action dated Aug. 1, 2008.
Korean Office Action dated May 28, 2007.

* cited by examiner

*Primary Examiner*—Richard Hjerpe
*Assistant Examiner*—Andrew Schnirel
(74) *Attorney, Agent, or Firm*—Ked & Associates LLP

(57) ABSTRACT

An organic electroluminescent device having an improved display quality without pectination is provided. The organic electroluminescent device comprises a plurality of the cathode electrode layers comprising a plurality of first cathode electrode layers, wherein one end of each first cathode electrode layer is connected to one of the scan lines extending in the first direction; a plurality of second cathode electrode layers, wherein one end of each second cathode electrode layer is connected to one of the scan lines extending in the second direction; and at least one third cathode electrode layer, wherein one end of each third cathode electrode layer is connected to one of the scan lines extending in the first direction, and the other end of each third cathode electrode layer is connected to one of the scan lines extending in the second direction.

10 Claims, 8 Drawing Sheets

Related Art

Related Art

LIGHT EMITTING DEVICE WITH AT LEAST ONE SCAN LINE CONNECTING TWO SCAN DRIVERS

BACKGROUND OF THE INVENTION

1. Field of the Invention

The present invention relates to a light emitting device, more particularly to an organic electroluminescent device having an improved display quality.

2. Description of the Related Art

Organic electroluminescence is a phenomenon wherein excitons are formed in an organic (low molecular or high molecular) material thin film by re-combining holes injected through an anode with electrons injected through a cathode, and a light of specific wavelength is generated by energy from thus formed excitons.

The basic structure of an organic electroluminescent device includes a transparent substrate, a plurality of anode electrode layers and a plurality of cathode electrode layers, disposed on the glass substrate so as to overlie each other, and an organic material layer interposed between the two electrode layers, wherein applying a voltage to the organic material layer through the two electrode layers allows the injected electrons and holes to re-combine each other and create an electroluminescent light.

FIG. 1A is a block diagram illustrating an organic electroluminescent device.

Referring to FIG. 1A, the organic electroluminescent device comprises a panel 100 and a driver 102 electrically connected thereto.

The panel 100 comprises a plurality of pixels E11 to E55, which correspond to luminescent areas that are defined as overlying areas of a plurality of anode electrode layers (hereinafter, referred to as "anode lines") A1 to A5 and a plurality of cathode electrode layers (hereinafter, referred to as "cathode lines") C1 to C5.

The driver 102 comprises a controller 104, a first scan driving circuit 106, a second scan driving circuit 108 and a data driving circuit 110.

The anode lines A1 to A5 are electrically connected to a data driving circuit 110 outside the panel 100 through data lines D1 to D5 to which the anode lines A1 to A5 are coupled, while the cathode lines C1 to C5 are electrically connected to scan driving circuits 106 and 108 outside the panel 100 through the scan lines S1 to S5 to which the cathode lines C1 to C5 are coupled.

The first scan driving circuit 106 is electrically connected to the scan lines S1, S3 and S5 extended in a first direction to transmit first scan signals to the cathode lines C1, C2 and C5 through the corresponding scan lines S1, S3 and S5. The second scan driving circuit 108 is electrically connected to the scan lines S2 and S4 extended in a second direction, which is different from the first direction, to transmit second scan signals to the cathode lines C2 and C4 through the corresponding scan lines S2 and S4.

A controller 104 transmits a first control signal CS1 to the first scan driving circuit 106, a second control signal CS2 to the second scan driving circuit 108, and a third control signal to the data driving circuit 110 to control the operations of the driving circuits 106, 108 and 110.

The data driving circuit 110 provides a data current corresponding to a display data input from the outside to the anode lines A1 to A5 through the data lines D1 to D5.

FIG. 1B is an equivalent circuit diagram of the panel 100 of FIG. 1A, illustrating an aspect of the cathode lines C1 to C2 being connected to the scan driving circuit (106 and 108 of FIG. 1A, indicated as a ground and a scan voltage V1 herein). In addition, FIG. 1C is an equivalent circuit diagram of some pixels of FIG. 1A, and FIG. 1D is a timing diagram illustrating a scan voltage and a data current provided through a scan line and a data line respectively.

Referring to FIG. 1B, some cathode lines C1, C3 and C5 of the cathode lines C1 to C5 are connected to scan lines S1, S3 and S5, which are extended in a first direction from one ends of the cathode lines C1, C3 and C5 to be connected to a scan voltage V1 or a ground, while the other cathode lines C2 and C4 are connected to scan lines S2 and S4, which are extended in a second direction from one ends of the cathode lines C2 and C4 to be connected to the scan voltage V1 or the ground.

Hereinafter, the operation of the pixels E11 to E55 will be described. Only, for convenience of the explanation, as shown in FIG. 1B, it is assumed that the resistance of each scan line S1 to S5 is 60Ω, and the resistance of each cathode line C1 to C5 of between the pixels E11 to E55 is 10Ω.

First, the first scan line S1 is connected to a ground while the other scan lines S2 to S5 are connected to the scan voltage V1, which has the same level as a driving voltage to drive the pixels E11 to E55. Here, only the pixels on the cathode line C1 connected to the scan line S1 emits a light because any pixel E11 to E55 emits a light only when the scan line S1 to S5 connected to its corresponding cathode line C1 to C5, is connected to the ground.

Next, the second scan line S2, which is extended in a different direction as that of the first scan line S1, is connected to the ground, while the other scan lines S1, S3, S4 and S5 are connected to the scan voltage V1. As a result, the pixels E12 to E52 on the cathode line C2, connected to the second scan line S2, emit a light.

For the foregoing case, line resistance components R11 to R51 of the pixels E11 to E51 on the cathode line C1 and line resistance components R12 to R52 of the pixels E12 to E52 on the cathode line C2 will be compared with reference to FIG. 1C.

Referring to FIG. 1C, the resistance components R11 and R12 of the adjoining two pixels E11 and E12 on the anode line A1 have a resistance difference of 40Ω, the resistance components R21 and R22 of the adjoining two pixels E21 and E22 on the anode line A2 have a resistance difference of 20Ω, and the resistance components R31 and R32 of the adjoining two pixels E31 and E32 on the anode line A3 have the same resistance as each other. Furthermore, the resistance components R41 and R42 of the adjoining two pixels E41 and E42 on the anode line A4 have a resistance difference of 20Ω, and the resistance components R51 and R52 of the adjoining two pixels E51 and E52 on the anode line A5 have a resistance difference of 40Ω.

Hereinafter, the influence of these line resistance differences on the brightness of each pixel E11 to E55 will be described with reference to FIG. 1D. Only, the case of the pixel E11 emitting a light will be provided as an example.

Referring to FIG. 1D, a data current I1 is provided to the pixel E11 through the data line D1 when the scan line S1 is at the low logic state. In theory, the data current I1 has a predetermined value Iw while the scan line S1 is at the low logic state, but in reality, the data current I1 has a lower value Iu than the predetermined value Iw as shown in FIG. 1D. That is, a data current is influenced by its corresponding resistance, and thus the brightness of the pixels E11 to E55 may have a variance due to the resistance components R11 to R55.

In the foregoing example, the case that the brightness of the pixels E11 to E55 is lowered due to the resistance components R11 to R55 has been provided, but the brightness of the pixels E11 to E55 may be increased in another case in another example.

Hereinafter, the operation of the panel 100 will be described in detail.

Referring again to FIG. 1C, the resistance components R11 and R12 of the pixels E11 and E12 on the anode line (A1 of FIG. 1B) have a greater resistance difference, therefore a considerable brightness difference between the pixels E11 and E12 may occur due to the resistance components R11 to R12 even though the same data current is provided to the pixels E11 and E12.

In addition, the brightness difference may occur between the pixels E12 to E55 on the other anode lines A2 to A5. But the brightness difference is conspicuous between the pixels E11 to E15 and E15 to E55 on the anode line (A1 and A5 of FIG. 1B) disposed at the edge of the panel. As a result, the brightness difference is repeated along the pixels E11 to E15 and E15 to E55 on the anode lines A1 and A5, thereby creating stripes, i.e. "pectination." Usually, the pectination generates along the left and right edges of the panel 100 to be noticeable to the users.

For the foregoing reasons, there is a need for a flat panel display device, such as a light emitting device, electroluminescent device or organic electroluminescent device, having an improved display quality without pectination.

SUMMARY OF THE INVENTION

The present invention is directed to a flat panel display device that satisfies the need defined in the Background of the Invention section.

A light emitting device according to one embodiment of the invention comprises a plurality of luminescent areas that are defined as overlying areas of a plurality of anode electrode layers and a plurality of cathode electrode layers; and a plurality of scan lines connected to one end of one of the plurality of the cathode electrode layers, wherein the scan lines extend in a first direction or in a second direction, wherein the first direction is different from the second direction. Here, The plurality of the cathode electrode layers comprises a plurality of first cathode electrode layers, wherein one end of each first cathode electrode layer is connected to one of the scan lines extending in the first direction; a plurality of second cathode electrode layers, wherein one end of each second cathode electrode layer is connected to one of the scan lines extending in the second direction; and at least one third cathode electrode layer, wherein one end of each third cathode electrode layer is connected to one of the scan lines extending in the first direction, and the other end of each third cathode electrode layer is connected to one of the scan lines extending in the second direction.

An electroluminescent device according to one embodiment of the invention comprises a plurality of cathode electrode layers disposed on a substrate in one direction; a plurality of anode electrode layers disposed to cross the plurality of the cathode electrode layers; a plurality of luminescent areas that are defined as crossing areas of the plurality of anode electrode layers and the plurality of cathode electrode layers; and a plurality of scan lines connected to one of the plurality of cathode electrode layers. Here, the plurality of scan lines comprises a plurality of first scan lines connected to and extended in a first direction from one end of one of the plurality of cathode electrode layer; and a plurality of second scan lines connected to and extended in a second direction from one end of one of the plurality of cathode electrode layers, wherein the second direction is different from the first direction, wherein at least one cathode electrode layer is connected to the scan lines at both two ends of the cathode electrode layer.

An organic electroluminescent device according to one embodiment of the invention comprises a plurality of luminescent elements formed on crossing areas of a plurality of anode electrode layers and a plurality of cathode electrode layers; and a plurality of scan lines for providing scan signals to select luminescent elements to provide a data current, wherein the electric potentials of the two ends of the at least one cathode electrode is substantially the same.

The flat panel display device according to the present invention has an advantage that the pectiantion does not occur.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Hereinafter, the embodiments of the present invention will be described in detail with reference to those accompanying drawings.

Figure 1A:
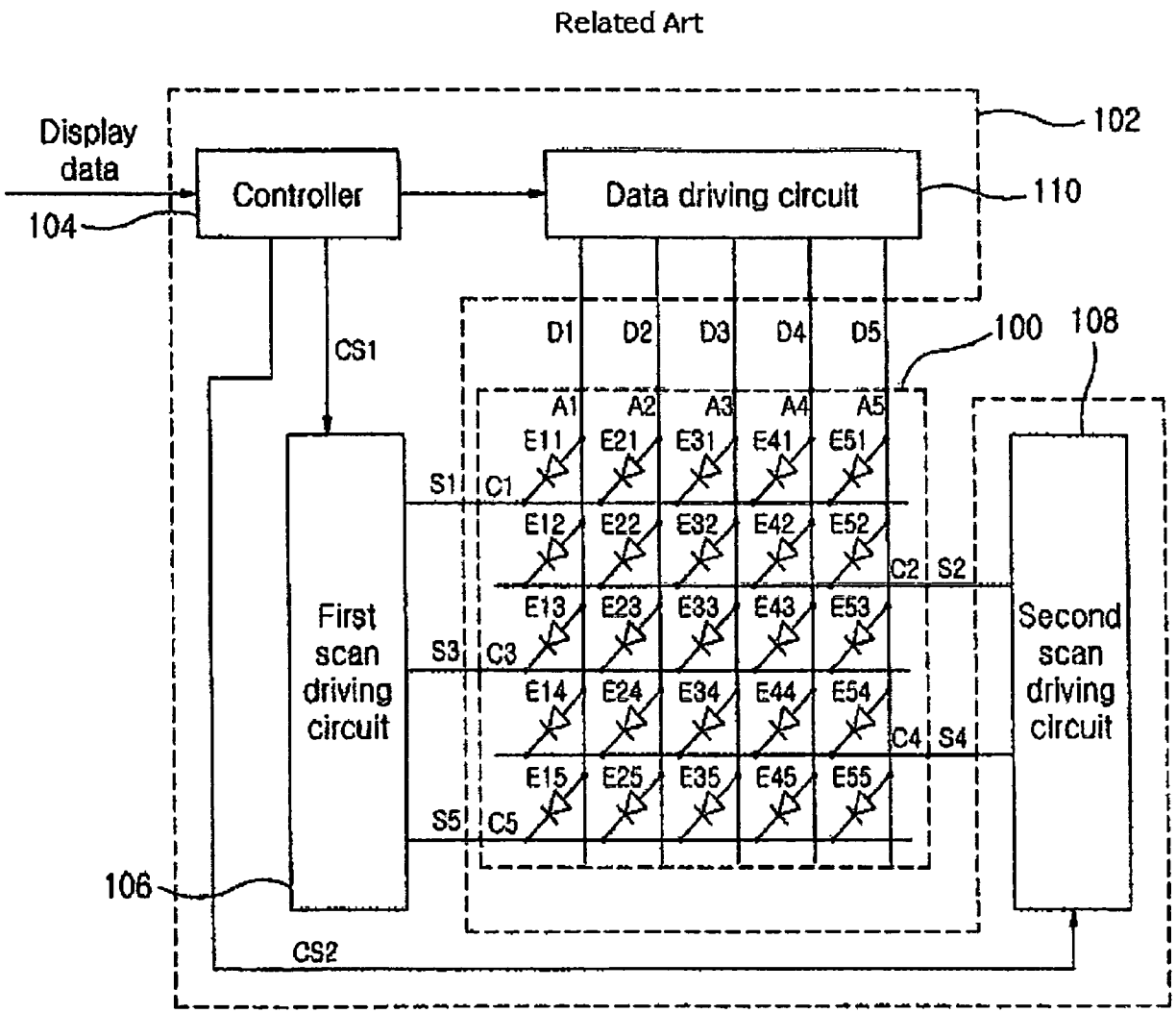
FIG. 1A is a block diagram illustrating an organic electroluminescent device.
Figure 1B:
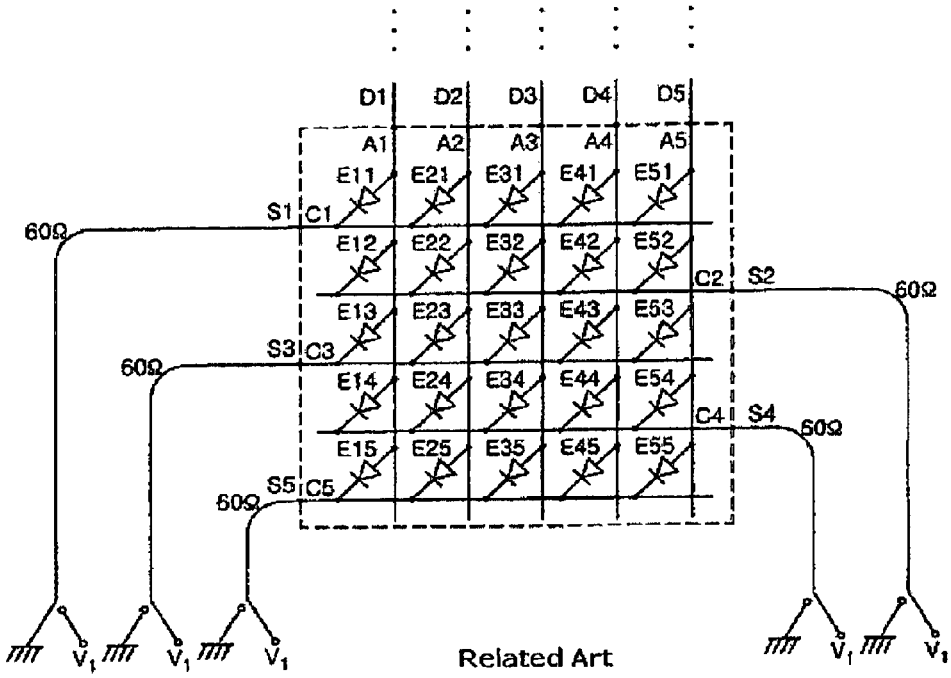
FIG. 1B is an equivalent circuit diagram of the panel of FIG. 1A, illustrating an aspect of cathode lines being connected to scan driving circuits.
Figure 1C:
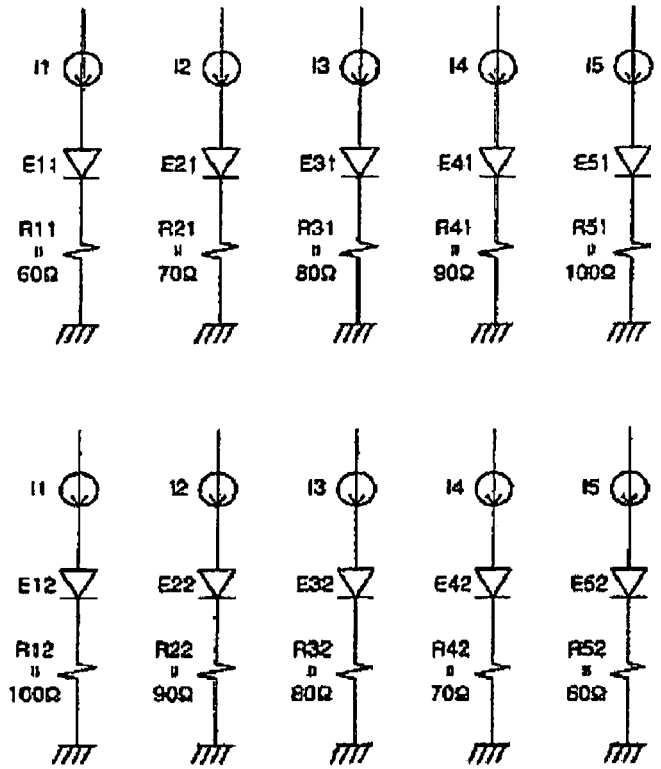
FIG. 1C is an equivalent circuit diagram of some pixels of FIG. 1A.
Figure 1D:
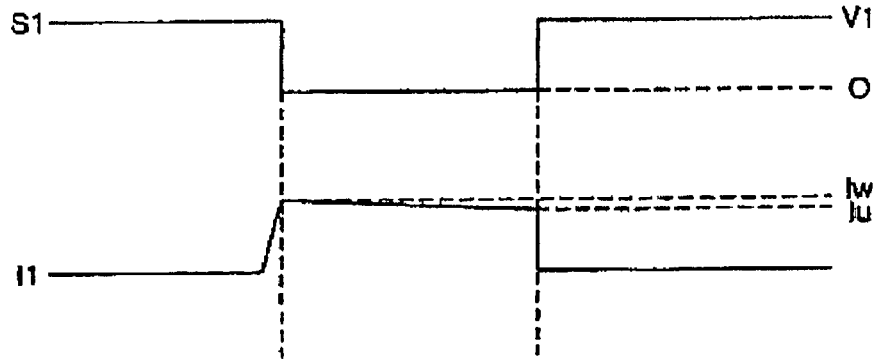
Related Art FIG. 1D
FIG. 1D is a timing diagram illustrating a scan voltage and a data current provided through a scan line and a data line respectively.
Figure 2:
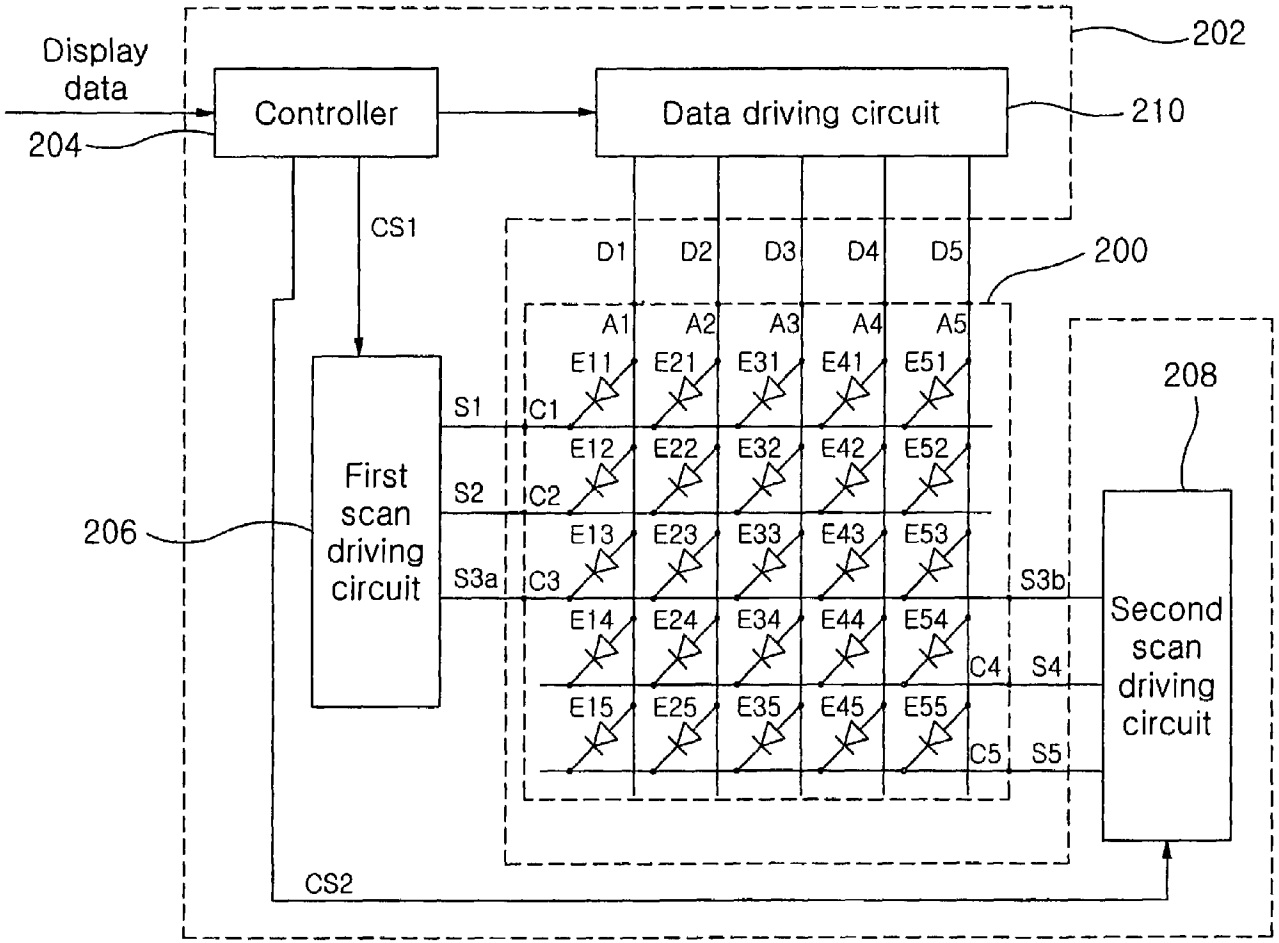
FIG. 2 is a block diagram illustrating an organic electroluminescent device according to a preferred embodiment of the present invention.

FIG. 2 is a block diagram illustrating an organic electroluminescent device according to a preferred embodiment of the present invention.

Referring to FIG. 2, an electroluminescent device according to one embodiment of the invention comprises a panel 200 and a driver 202.

A panel 200 comprises a plurality of pixels E11 to E55 formed in luminescent areas that are defined as overlying areas of a plurality of anode lines A1 to A5 (anode electrode layers) and a plurality of cathode lines C1 to C5 (cathode electrode layers). The anode lines A1 to A5 are connected to data lines D1 to D5 to be connected to data driving circuit 210 outside the panel 200, and the cathode lines are connected to the scan lines S1 to S5 to be connected to scan driving circuit 106 and 108 outside the panel 200.

Each pixel E11 to E55 comprises an anode electrode layer, a cathode electrode layer, and an organic material layer interposed between the two electrode layers, wherein the organic material layer comprises a Hole Transporting Layer (HTL), an Emitting Layer (EML), and an Electron Transporting Layer (ETL).

Applying a positive voltage to the anode electrode layer and a negative voltage to the cathode electrode layer respectively, the HTL transports holes injected from the anode electrode layer, and the ETL transports electrons injected from the cathode electrode layer. Subsequently, the transported holes and electrons re-combine to emit an electroluminescent light from the EML.

The driver 202 comprises a controller 204, a first scan driving circuit 206, a second driving circuit 208 and a data driving circuit.

A first scan driving circuit 206 is electrically connected to scan lines S1 to S3*a* extended in a first direction from one ends of cathode lines C1 to C3 to transmit first scan signals to the corresponding cathode lines C1 to C3 through the scan lines S1 to S3*a*.

A second scan driving circuit 208 is electrically connected to scan lines S3*b* to S5 extended in a second direction, different from the first direction, from one end of cathode lines C3 to C5 to transmit second scan signals to the corresponding cathode lines C3 to C5 through the scan lines S3*b* to S6.

Here, one end of the cathode line C3 is connected to scan line S3*a* that is extended in the first direction, and the other end of the cathode line C3 is also connected to another scan line S3*b* that is extended in the second direction. Furthermore, the two ends of the cathode line C3 are connected to both the first scan driving circuit 206 and the second driving circuit 208 through the two scan lines S3*a* and S3*b*. The first and second scan signals transmitted through the scan lines S3*a* and S3*b* to the cathode line C3 are the same.

Hereinafter, the positional relation of the scan lines S1 to S5 will be described in detail.

The organic electroluminescent device according to one embodiment of the present invention comprises at least one cathode lines C3 electrically connected to both the first scan driving circuit 206 and the second driving circuit 208. In one embodiment, the cathode line C3 is disposed between the cathode line C2 connected to the scan line S2 extended in the first direction and the cathode line C4 connected to the scan line S4 extended in the second direction as shown in FIG. 2. In another embodiment, the cathode line C3 may be disposed between two cathode lines connected to scan lines extended in the same direction. Only, it is noted that in an organic electroluminescent device of the invention, a cathode line connected to scan lines extended in the two directions, such as the cathode line C3 of FIG. 2, is always disposed between a cathode line connected to a scan line extended in the first direction and another cathode line connected to a scan line extended in the second direction. The reason for disposing the cathode lines and scan lines in the foregoing way will be described hereinafter with reference to the accompanying drawings.

A controller 204 transmit a first control signal CS1 to the first scan driving circuit 206, a second control signal CS2 to the second scan driving circuit 208, and a third control signal to the data driving circuit 210 to control the operations of the driving circuits 206, 208 and 210. In particular, the controller 204 controls to connect the two scan lines S3*a* and S3*b* of the cathode line C3 to an electroluminescent initiation voltage simultaneously, for an example a ground, when the cathode line C3 is selected.

The data driving circuit 210 provides a data current corresponding to a display data input from the outside to the anode lines A1 to A5 through the data lines D1 to D5.

Figure 3:
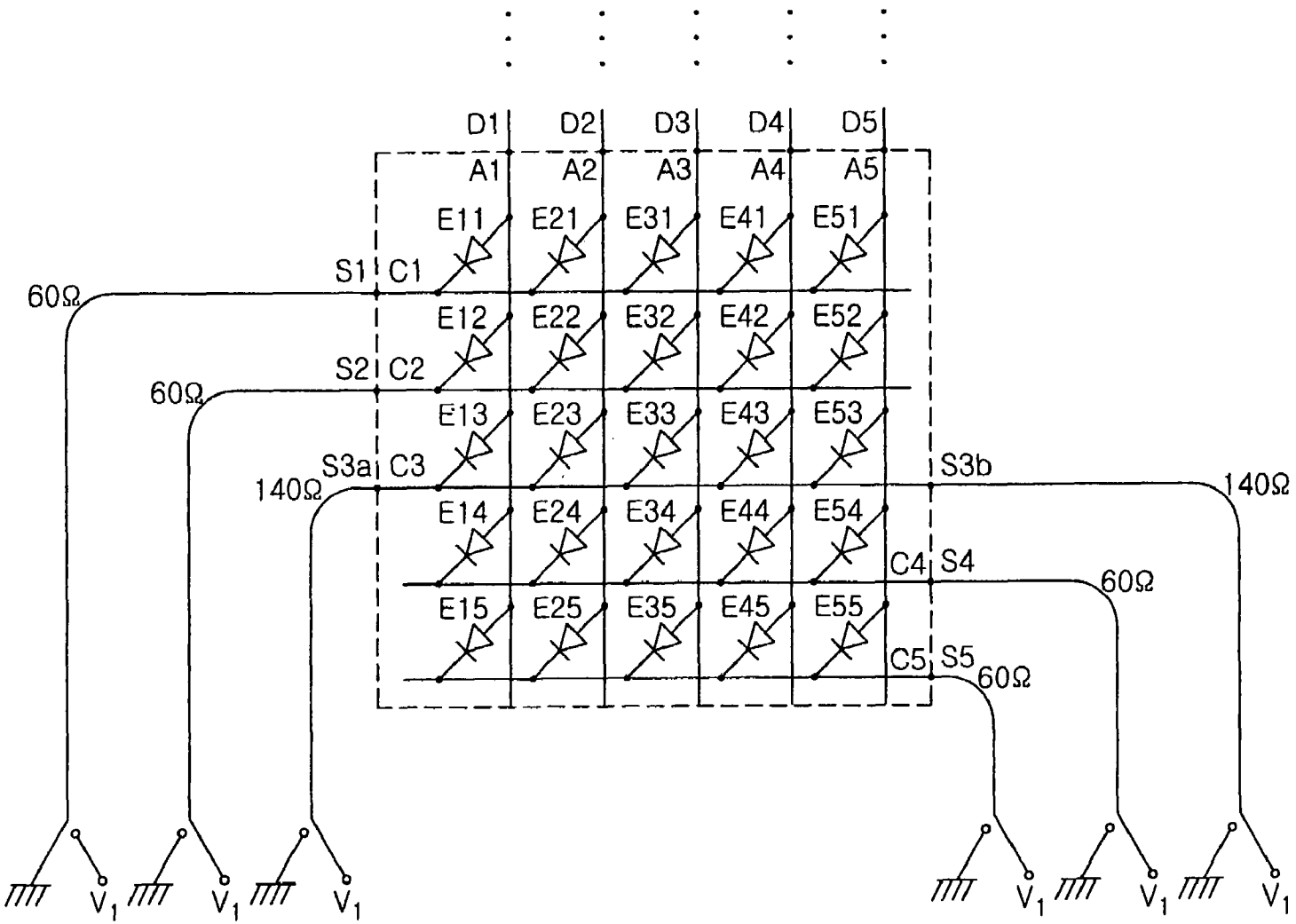
FIG. 3 is a circuit diagram of the panel of FIG. 2, illustrating an aspect of cathode lines being electrically connected to scan driving circuit through scan lines.
Figure 4A:
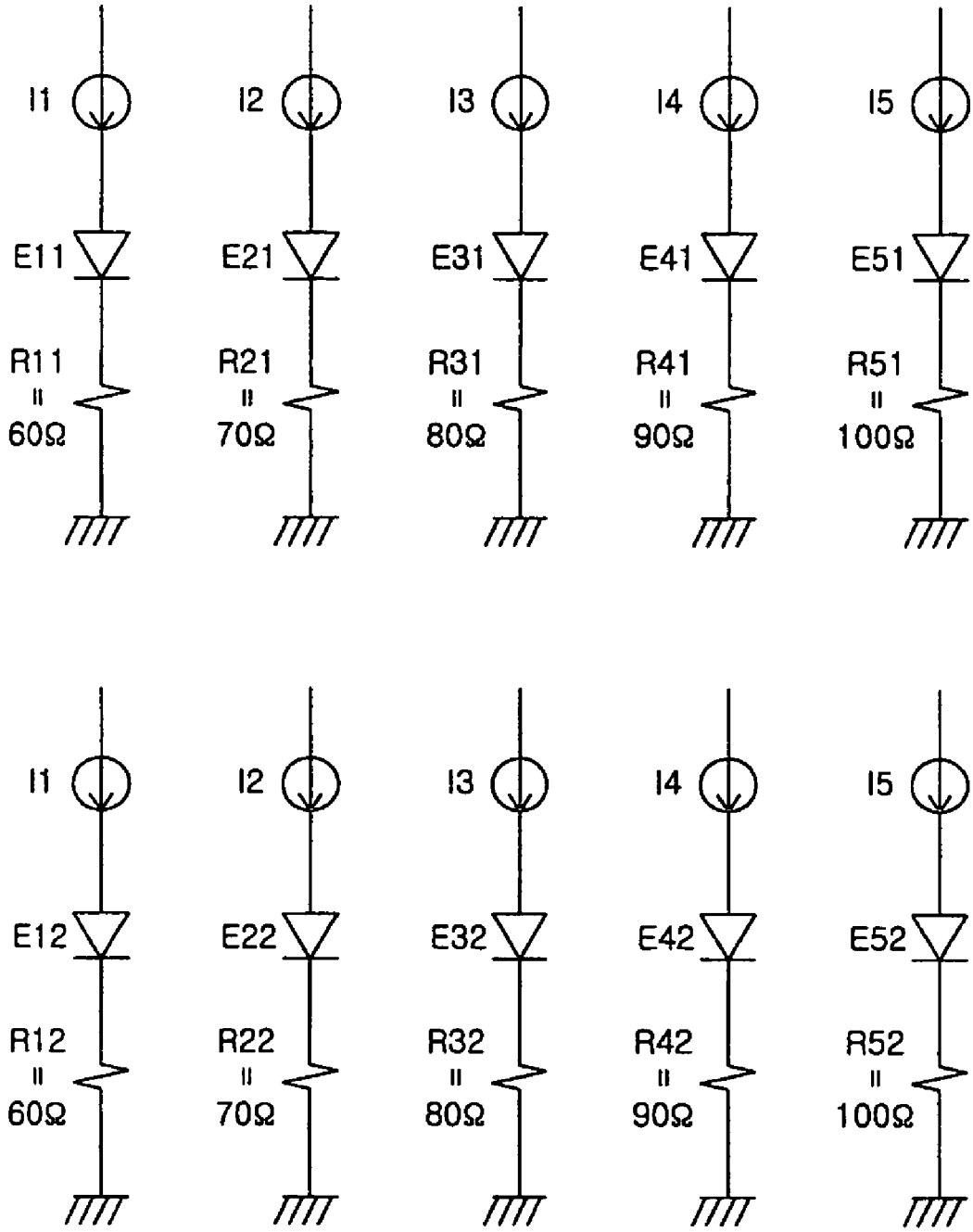
FIG. 4A-4C are equivalent circuit diagrams of some pixels included in the panel of FIG. 3.
Figure 4B:
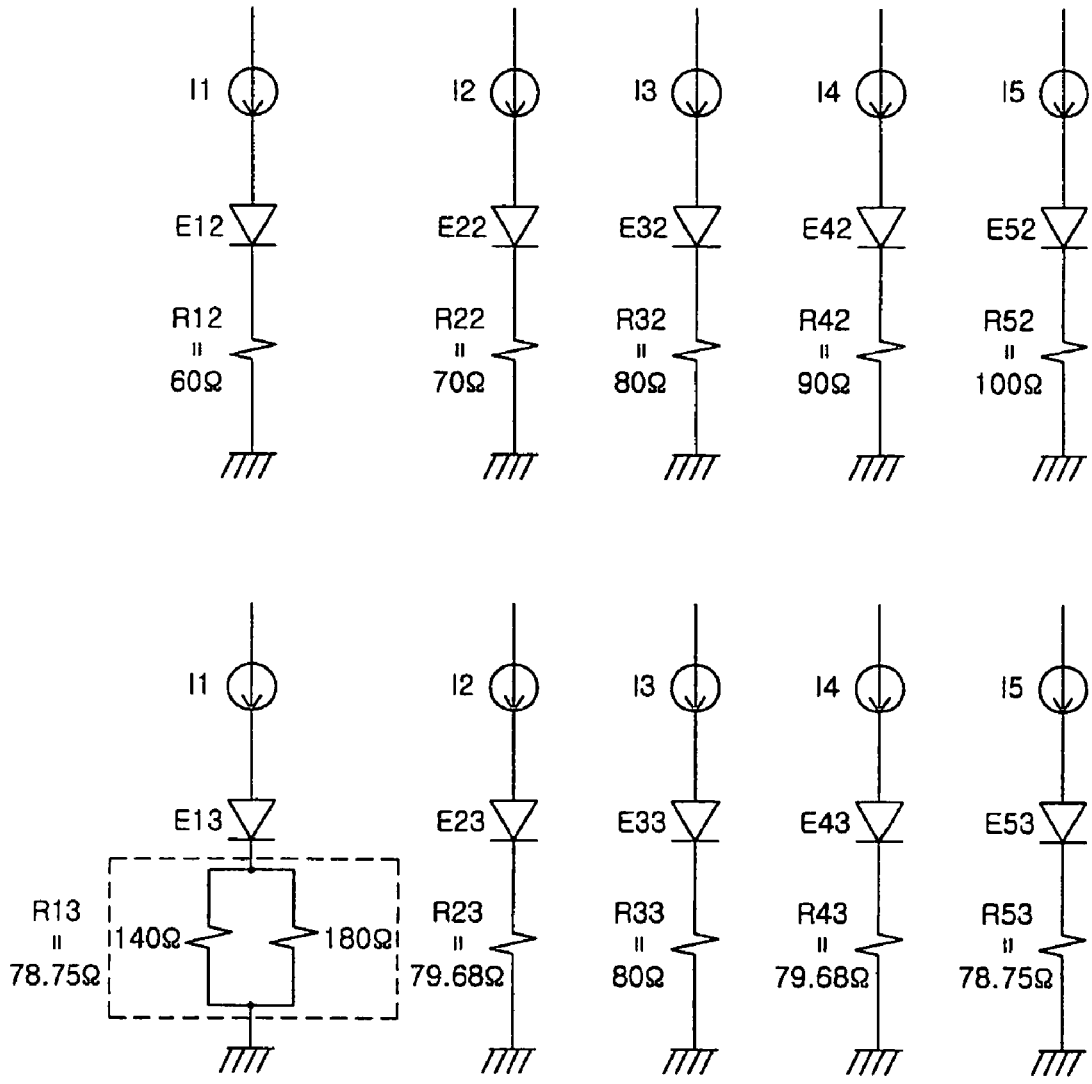
Figure 4C:
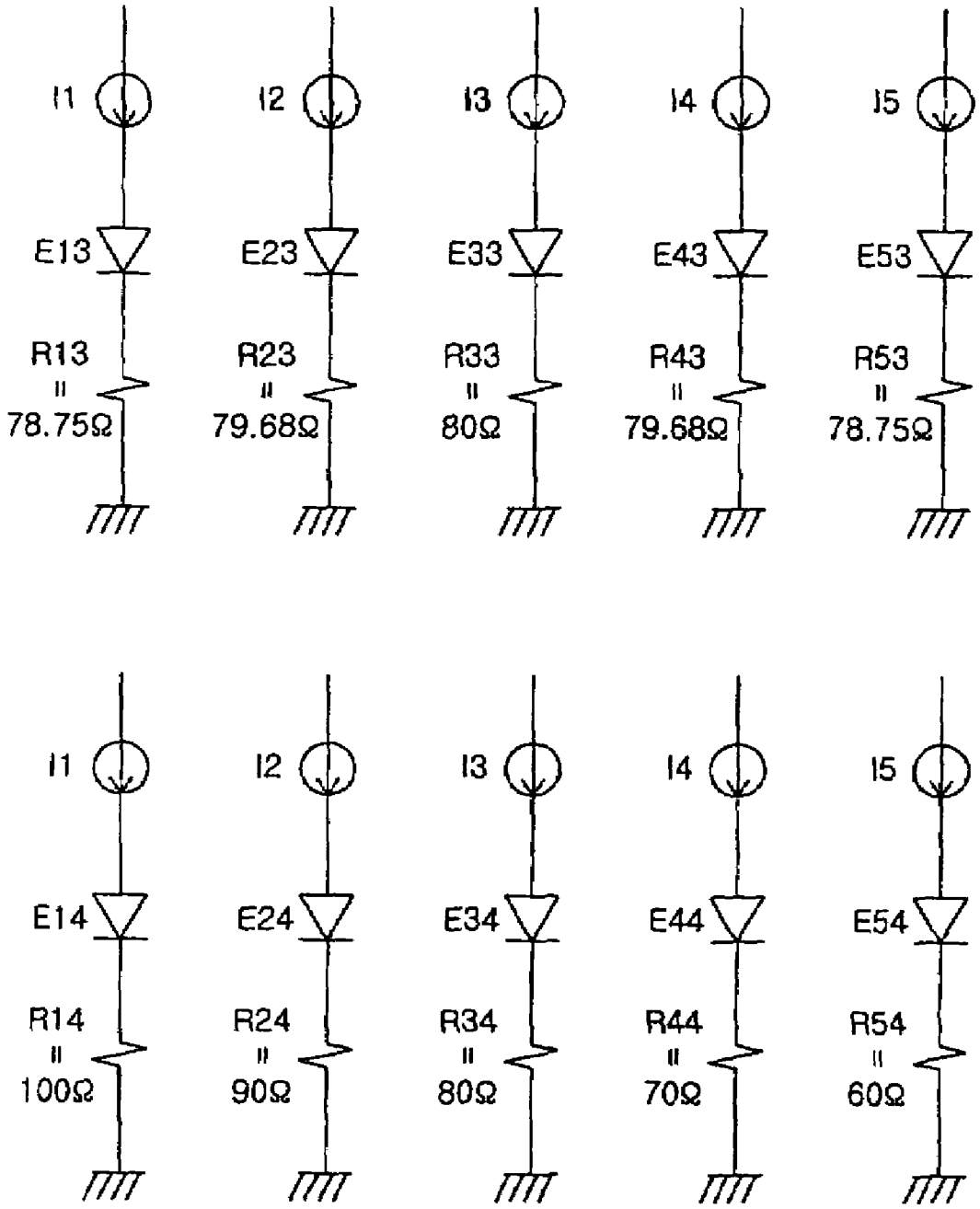

FIG. 3 is a circuit diagram of the panel of FIG. 2, illustrating an aspect of cathode lines C1 to C5 being electrically connected to scan driving circuit (206 and 208 of FIG. 2, herein indicated as a ground and a scan voltage) through scan lines S1 to S5. FIG. 4A-4C are equivalent circuit diagrams of some pixels included in the panel of FIG. 3.

Referring to FIG. 3, the scan lines S1 and S2 each is extended in a first direction from one end of the cathode lines C1 and C2 to be connected to the ground or the scan voltage V1, while the scan lines S4 and S5 each is extended from one end of the cathode lines C4 and C5 in a second direction that is different from the first direction. The scan line S3*a* is extended in the first direction from one end of the cathode line C3 to be connected to the ground or the scan voltage V1, and the scan line S3*b* is extended in the second direction from the other end of the cathode line C3 to be connected to the ground or the scan voltage V1.

Hereinafter, the operation of the pixels E11 to E55 will be described. Only, as shown in FIG. 3, it is assumed that the line resistance values of each scan line S1 to S5 are 60Ω or 140Ω, and the line resistance values of the cathode line of between the pixels E11 to E55 is 10Ω.

First, the scan line S1 is connected to a ground, while all the other scan lines S2 to S5 are connected to the scan voltage V1, which corresponds to a driving voltage for driving the pixels E11 to E55. Here, the pixels E11 to E51 on the cathode line C1, which is connected to the scan line S1, because the pixel E11 to E55 emit a electroluminescent light only when the scan line S1 to S5 connected to the corresponding pixel E11 to E55 is connected to the ground.

Subsequently, the scan line S2, which is extended in the same direction as the direction of the scan line S1, is connected to the ground, the other scan lines S1, S3, S4 and S5 are connected to the scan voltage V1. As a result, only the pixels E12 to E52, which are on the cathode line C, emit a light.

Hereinafter, the line resistance components R11 to R51 of the pixels E11 to E51 on the cathode line C1 and the line resistance components R12 and R52 of the pixels E12 to E52 on the cathode line C2 will be compared with reference to FIG. 4A.

Referring to FIG. 4A, the line resistance components R11 to R12 of the pixels E11 and E12 connected to the data line D1 have the same value; the line resistance components R21 and R22 of the pixels E21 and E22 connected to the data line D2 have the same value; and the line resistance components of the pixels E31 and E32 connected to the data line D3 have the same value. In addition, the line resistance components R41 to R42 of the pixels E41 and E42 connected to the data line D4 have the same value; and the line resistance components R51 to R52 of the pixels E51 and E52 connected to the data line D5 have the same value. Therefore, the brightness difference may not be generated between the pixels E11 to E51 on the cathode line C1 and the pixels E12 to E52 on the cathode line C2. In short, the brightness difference may not occur between the cathode lines connected to the scan lines extended in the same direction.

Referring again to FIG. 3, the scan lines S3*a* and S3*b* are connected to the ground simultaneously, the other scan lines S1, S2, S4 and S5 are connected to the scan voltage V1. As a result, only the pixels E13 to E53 on the cathode line C3 connected to the scan line S3*a* and S3*b* emit a light.

Hereinafter, the line resistance components R12 to R52 of the pixels E12 to E52 on the cathode line C2 and the line resistance components R13 and R53 of the pixels E13 to E53 on the cathode line C3 will be compared with reference to FIG. 4B.

Referring to FIG. 4B, the line resistance component R12 of the pixel E12 connected to the data line D1 and the line resistance component R13 of the pixel E13 have different values, and thus the brightness difference may be generated between the two pixels E12 and E13 when emitting a light. However, such brightness difference is as much negligible as visually unrecognizable to viewers because the resistance difference between the line resistance components R12 and R13 is relatively small unlike in the organic electroluminescent device presented in the above the Description of the Related Art section. Comparing the brightness of the pixels E12 to E52 on the cathode line (C3 of FIG. 3) connected to the scan line S2 and the brightness of the pixels E13 to E53 on the cathode line (C4 of FIG. 3) connected to the scan line S3, there may be a brightness difference, which is visually unrecognizable to viewers. In short, there is no brightness difference, which can be visually recognizable to viewers, between any cathode line connected to the scan line extended in the first direction and the cathode line connected to the scan line at its both ends.

Subsequently, the scan line S4 is connected to the ground while the other scan lines S1, S2, S3 and S5 are connected to the scan voltage V1. As a result, only the pixels E14 to E54 on the cathode line C4 connected to the scan line S4 emit a light.

Hereinafter, the line resistance components R13 to R53 of the pixels E13 to E53 on the cathode line C3 and the line resistance components R14 to R54 of the pixels E14 to E54 on the cathode line C4 will be compared with reference to FIG. 4C.

Referring to FIG. 4C, the line resistance component R13 to R53 of the pixel E13 to E53 on the cathode line C3 and the line resistance component R14 to R54 of the pixel E14 to E54 on the cathode line C4 have different values, and thus the brightness difference may be generated between the pixels E13 to E53 on the cathode line C3 and the pixels E14 to E54 on the cathode line C4. However, such brightness difference is as much negligible as visually unrecognizable to viewers because the resistance difference between the line resistance components R13 to R53 of the pixels E13 to E53 on the cathode line C3 and the line resistance components R14 to R54 of the pixels E14 to E54 on the cathode line C4 is relatively small. In short, there is no brightness difference, which can be visually recognizable to viewers, between any cathode line connected to the scan line extended in the second direction and the cathode line connected to the scan line at its both ends.

As described above, in the electroluminescent device of the present invention, there is no brightness difference due to a line resistance difference between cathode lines connected to scan lines extended in the same direction. Also, there may not any brightness difference, which is visually recognizable to viewers, between a cathode line connected to a scan line extended in any one direction and another cathode line connected to scan lines at its both ends. Thus, according to the present invention, there is an advantage that an organic electroluminescent device having an improved display quality without pectination can be obtained, unlike the electroluminescent device presented in the above the Description of the Related Art section, where the pectination due to repeated brightness differences is clearly recognized to viewers.

The preferred embodiments of the present invention have been described for illustrative purposes, and those skilled in the art will appreciate that various modifications, additions, and substitutions are possible, without departing from the scope and spirit of the present invention as disclosed in the accompanying claims.

What is claimed is:

1. An organic light emitting device comprising:

a panel having a plurality of first scan lines, a plurality of second scan lines and at least one third scan line;

a first scan driver disposed on one side of the panel; and a second scan driver disposed on the other side of the panel, wherein the plurality of first scan lines connected to the first scan driver, the plurality of second scan lines connected to the second driver and the at least one third scan line connected to both the first scan driver and the second scan driver.

2. The organic light emitting device of claim 1, wherein the first scan lines and the second scan lines are separated by the at least one third scan line.

3. The organic light emitting device of claim 1, the resistance of the third scan line is greater than the resistance of any other scan line.

4. The organic light emitting device of claim 1, wherein the first scan driver is electrically connected to a plurality of first cathode lines disposed on the panel by the scan lines extending in the first direction, and wherein the second scan driver is electrically connected to a plurality of second cathode lines disposed on the panel by the scan lines extending in the second direction.

5. The organic light emitting device of claim 1, wherein the electric potentials of the two both ends of the at least one scan lane is substantially the same.

6. A light emitting device comprising:

a plurality of anode lines and a plurality of cathode lines includes a plurality of first cathode lines being disposed adjacent to each other and a plurality of second cathode lines being disposed adjacent to each other, and at least one third cathode line;

a plurality of luminescent areas defined as overlying area of the plurality of the anode lines and of the plurality of cathode lines; and a plurality of scan lines, wherein:

each of the plurality of first cathode lines is connected to only one scan line of a plurality of first scan lines extend in a first direction;

each of the plurality of second cathode lines is connected to only one scan line of a plurality of second scan lines extend in a second direction different from the first direction;

the at least one third cathode line is connected to a scan line of a plurality of third scan lines that extend in the first direction and the second direction.

7. The light emitting device of claim 6, wherein the first cathode lines and the second cathode lines are separated by the at least one third cathode line.

8. The light emitting device of claim 6, wherein resistance of the scan line connected to the third cathode line is greater than resistance of another scan line connected to the first cathode line or the second cathode line.

9. The light emitting device of claim 6, further comprising a first scan driver, wherein the first scan driver is electrically connected to some of the scan lines by the scan lines extending in the first direction;

a second scan driver, wherein the second driver is electrically connected to some of the scan lines by the scan lines extending in the second direction; and a controller for controlling the operation of the first scan driver and the second scan driver, wherein the at least one third cathode line is electrically connected to both the first scan driver and the second scan driver by the scan lines extending in the first or the second direction.

10. The light emitting device of claim 9, wherein the electric potentials of the two ends of the third cathode line is substantially the same.

* * * * *